US009671123B2

(12) United States Patent
Lee et al.

(10) Patent No.: US 9,671,123 B2
(45) Date of Patent: Jun. 6, 2017

(54) AIR CONDITIONER

(75) Inventors: Dong Gyu Lee, Suwon-si (KR); Ho Yoon, Yongin-si (KR); Jae Hun Choi, Osan-si (KR); Tae Ha Jun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1031 days.

(21) Appl. No.: 13/598,073

(22) Filed: Aug. 29, 2012

(65) Prior Publication Data

US 2013/0067941 A1 Mar. 21, 2013

(30) Foreign Application Priority Data

Sep. 19, 2011 (KR) ..... 10-2011-0093847

(51) Int. Cl.

*B23K 9/10* (2006.01)
*A61L 9/22* (2006.01)
*F24F 11/00* (2006.01)

(52) U.S. Cl.

CPC ..... *F24F 11/006* (2013.01); *F24F 2011/0061* (2013.01); *F24F 2011/0075* (2013.01)

(58) Field of Classification Search

CPC ..... F24F 11/0012; F24F 11/0009; B23K 9/10; H04B 3/548; H02M 3/1584; A61L 9/22
USPC ..... 340/660; 323/282
See application file for complete search history.

(56) References Cited

U.S. PATENT DOCUMENTS 5,824,990 A * 10/1998 Geissler ..... B23K 9/10 219/130.21
2004/0007000 A1* 1/2004 Takeda ..... A61L 9/22 62/78
2007/0101173 A1* 5/2007 Fung ..... 713/300
2007/0131784 A1* 6/2007 Garozzo ..... F24F 11/0009 236/51

(Continued)

FOREIGN PATENT DOCUMENTS

CN 1987243 6/2007
CN 101165421 4/2008

(Continued)

OTHER PUBLICATIONS

Chinese Patent Office Action issued in Chinese Patent Application No. 201210347359.7 dated Apr. 5, 2016 (6 pages).

*Primary Examiner* — Ryan J Walters
*Assistant Examiner* — Meraj A Shaikh
(74) *Attorney, Agent, or Firm* — Staas & Halsey LLP

(57) ABSTRACT

An air conditioner having an indoor unit and an outdoor unit, at least one of which includes a communication unit, a switching unit turned on when communication lines are connected to the communication unit, turned off in a standby mode, and turned on when the standby mode is released, a voltage distribution unit distributing voltage applied to the communication unit when the switching unit is turned off, a voltage adjustment unit adjusting the voltage applied to the communication unit and transmitting the adjusted voltage to the communication unit, and a control unit turning the switching unit on when driving voltage is input to the control unit, turning the switching unit off when the at least one of the indoor unit and the outdoor unit enters the standby mode, and turning the switching unit on based on the voltage distributed by the voltage distribution unit in the standby mode.

14 Claims, 7 Drawing Sheets

(56) References Cited

U.S. PATENT DOCUMENTS

| | | | | |
|---|---|---|---|---|
| 2008/0147242 | A1* | 6/2008 | Roher | F24F 11/0012 700/278 |
| 2012/0086416 | A1* | 4/2012 | Kudo | H02M 3/1584 323/265 |
| 2012/0126019 | A1* | 5/2012 | Warren | F24F 11/0012 236/51 |
| 2012/0228927 | A1* | 9/2012 | Matsumoto | H04B 3/548 307/3 |

FOREIGN PATENT DOCUMENTS

| | | |
|---|---|---|
| JP | 3019844 | 3/2000 |
| JP | 2010-54065 | 3/2010 |
| JP | 2010-159887 | 7/2010 |
| KR | 10-2011-0026302 | 3/2011 |
| WO | WO 2011/013716 | 2/2011 |

* cited by examiner

AIR CONDITIONER

CROSS-REFERENCE TO RELATED APPLICATIONS

This application claims the benefit of Korean Patent Application No. 10-2011-0093847, filed on Sep. 19, 2011 in the Korean Intellectual Property Office, the disclosure of which is incorporated herein by reference.

BACKGROUND

1. Field

Embodiments of the present disclosure relate to an air conditioner which prevents a failure due to a line connection error between devices and saves standby power.

2. Description of the Related Art

An air conditioner is an apparatus which cools, heats or purifies sucked air using heat movement occurring during compression, condensation, expansion and evaporation processes of a refrigerant, and then discharges the air to condition air of a specific indoor space.

Such an air conditioner includes a compressor compressing the refrigerant into a high-temperature and high-pressure state, a condenser condensing the refrigerant in the high-temperature and high-pressure state supplied from the compressor into a low-temperature and high-pressure liquid state through heat exchange with surrounding air, an expansion valve (or a capillary tube) decompressing the refrigerant in the low-temperature and high-pressure liquid state supplied from the condenser into a low-temperature and low-pressure liquid or gaseous state, an evaporator passing and evaporating the refrigerant in the low-temperature and low-pressure state supplied from the expansion valve to rob of surrounding heat to maintain a low external temperature, an air blower fan discharging the air cooled by the evaporator to the indoor space, and an accumulator filtering the refrigerant in the liquid state from among the refrigerant evaporated by the evaporator and causing the filtered refrigerant to be introduced back into the compressor.

The compressor and the condenser are located within an outdoor unit, the evaporator and the air blower fan are located within an indoor unit, and the indoor unit and the outdoor unit perform operation according to a command from a controller.

The controller is generally a wireless remote controller, but may be a wired controller due to a possibility of losing the wireless remote controller in case of a multi-air conditioner respectively conditioning air in a plurality of indoor spaces.

Two power lines and two communication lines are connected between the indoor unit and the outdoor unit of the air conditioner and between the indoor unit and the wired controller of the air conditioner. The indoor unit and the outdoor unit of the air conditioner, or the indoor unit and the wired controller of the air conditioner transmit and receive power through the two power lines and perform mutual communication based on a designated communication protocol through the two communication lines.

An installer needs to connect the two power lines and the two communication lines between the indoor unit and the outdoor unit when the indoor unit and the outdoor unit are installed, and needs to connect the two power lines and the two communication lines between the indoor unit and the wired controller when the wired controller is installed.

Therefore, the probability of occurrence of a line connection error between the power lines and the communication lines when the air conditioner is installed is high, the probability of occurrence of a failure of a communication circuit is high, and repair costs arise when the communication circuit failure occurs.

Particularly, as the numbers of outdoor units and indoor units in a multi-air conditioner increase, connection between communication lines and power lines is complicated and installation of the air conditioner is not easy.

Therefore, the communication circuit failure due to the line connection error is prevented by installing relays at communication terminals of communication circuits of the indoor unit and the outdoor unit such that the relay is turned on when the communication lines are normally connected and is turned off when a line connection error occurs due to connection of the power lines. Even if a line connection error between the communication lines and the power lines between the devices occurs, a part failure does not occur, and thus line connection between devices is facilitated.

However, since the relay needs to maintain the on state to achieve communication between the devices even in a standby mode, standby power is not saved.

Particularly, an air conditioner in a type in which power is applied to an outdoor unit consumes the same amount of power as in a general mode to receive a user command input to an indoor unit in the standby mode in which power of the outdoor unit is blocked.

Further, if the relay is turned off to minimize standby power in the standby mode, the communication lines may be cut off, communication signals from other devices may not be received, and thus the standby mode may not be released.

SUMMARY

Therefore, it is an aspect of the present disclosure to provide an air conditioner which saves standby power in a standby mode and releases the standby mode when a standby mode release signal from another device is received.

It is another aspect of the present disclosure to provide an air conditioner which distributes voltage supplied from a communication unit and adjusts the distributed voltage to prevent a failure due to a line connection error between devices.

Additional aspects of the disclosure will be set forth in part in the description which follows and, in part, will be apparent from the description, or may be learned by practice of the disclosure.

In accordance with an aspect of the present disclosure, in an air conditioner including an indoor unit and an outdoor unit to perform communication with each other, at least one of the indoor unit and the outdoor unit includes a switching unit to be turned off in a standby mode, to be turned on when the standby mode is released, and to transmit and receive communication signals between the indoor unit and the outdoor unit, a voltage distribution unit to distribute voltage of the signal received in the standby mode, a communication unit to generate a standby mode release signal when voltage more than reference voltage is input to the communication unit from the voltage distribution unit in the standby mode, and a control unit to determine a point in standby mode entering time, turning the switching unit off upon determining that this point in time is the point in standby mode entering time, and turning the switching unit on when the standby mode release signal is received through the communication unit in the standby mode.

The switching unit may include relays, and the voltage distribution unit may include resistances.

The resistances may be connected to the relays in parallel.

The at least one of the indoor unit and the outdoor unit may further include a conversion unit to respectively convert voltage of power supplied from the outside into voltages necessary to drive the communication unit, the switching unit and the control unit, and the control unit may turn the switching unit on when the voltage necessary to drive the communication unit is applied to the communication unit.

In accordance with another aspect of the present disclosure, in an air conditioner including an indoor unit and an outdoor unit connected through power lines and communication lines, at least one of the indoor unit and the outdoor unit includes a communication unit to perform communication, a switching unit turned on when the communication lines are connected to the communication unit, to be turned off in a standby mode, and to be turned on when the standby mode is released, a voltage distribution unit to distribute voltage applied to the communication unit when the switching unit is turned off, a voltage adjustment unit to adjust the voltage applied to the communication unit to a designated voltage and to transmit the adjusted voltage to the communication unit, and a control unit to turn the switching unit on when driving voltage is input to the control unit, to turn the switching unit off when the at least one of the indoor unit and the outdoor unit enters the standby mode, and to turn the switching unit on based on the voltage distributed by the voltage distribution unit in the standby mode.

The at least one of the indoor unit and the outdoor unit may further include a conversion unit to respectively convert voltage of power supplied from the outside into voltages necessary to drive the communication unit, the switching unit and the control unit.

The control unit may determine whether or not the communication lines are connected to the communication unit based on voltage of driving power applied from the conversion unit.

The control unit may include an output unit to inform a connection of the communication lines to the communication unit.

The voltage distribution unit may distribute voltage of a signal received in the standby mode, and the communication unit may generate a standby mode release signal when voltage more than reference voltage is input to the communication unit from the voltage distribution unit in the standby mode.

The control unit may turn the switching unit on when the standby mode release signal is received through the communication unit in the standby mode.

The switching unit may include relays, and the voltage distribution unit may include resistances.

The resistances may be connected to the relays in parallel.

The communication unit may include a first input and output terminal and a second input and output terminal, to input and output communication signals, and the voltage distribution unit may include a first resistance connected to the first input and output terminal and a second resistance connected to the second input and output terminal, and distribute voltage applied to the communication unit using the first resistance and the second resistance.

The at least one of the indoor unit and the outdoor unit may further include an impedance between the first input and output terminal and the second input and output terminal, and the voltage applied to the communication unit may be distributed by the first resistance, the second resistance and the impedance.

From among the distributed voltages, voltage generated by the impedance may be voltage necessary to generate a trigger signal of the control unit.

The switching unit may include a first relay connected to the first input and output terminal and a second relay connected to the second input and output terminal, and the first resistance may be connected to the first relay in parallel and the second resistance may be connected to the second relay in parallel.

The voltage adjustment unit may be provided between the first and second input and output terminals.

The voltage adjustment unit may include two Zener diodes, anodes of which contact each other.

The voltage adjustment unit may include two pairs of Zener diodes and general diodes, anodes of which contact each other.

One pair of Zener diode and general diode may adjust voltage applied to the first input and output terminal and the other pair of Zener diode and general diode may adjust voltage applied to the second input and output terminal.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
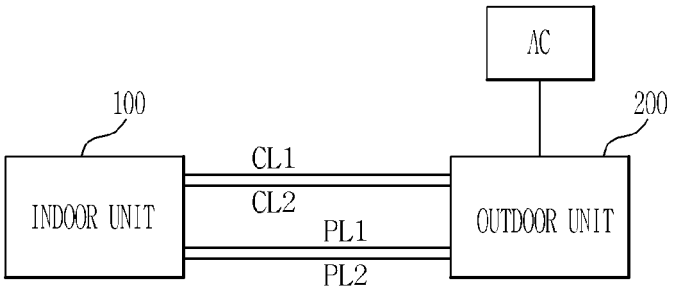
FIG. 1 is a view illustrating the configuration of an air conditioner in accordance with an embodiment of the present disclosure.

Reference will now be made in detail to embodiments of the present disclosure, examples of which are illustrated in the accompanying drawings, wherein like reference numerals refer to like elements throughout.

FIG. 1 is a view illustrating the configuration of an air conditioner in accordance with an embodiment of the present disclosure, and the air conditioner includes an indoor unit 100 and an outdoor unit 200.

The indoor unit 100 of the air conditioner is a device installed in an indoor space to maintain air in a comfortable state. The indoor unit 100 is connected to the outdoor unit 200 through a refrigerant pipe (not shown), receives a refrigerant supplied from the outdoor unit 200, and transmits the refrigerant to the outdoor unit 200 after heat exchange of the supplied refrigerant has been performed.

Such an indoor unit 100 includes an indoor heat exchanger (not shown) absorbing external heat while evaporating a refrigerant in a liquid state, expanded by an expansion device of the outdoor unit 200 and then transmitted through a refrigerant pipe, to a gaseous state, and an indoor fan (not shown) blowing indoor air to the indoor heat exchanger and blowing air, heat-exchanged in the indoor heat exchanger, to the indoor space.

Further, the indoor unit 100 is electrically connected to the outdoor unit 200 through two communication lines CL1 and CL2 and two power lines PL1 and PL2, transmits and receives communication signals to and from the outdoor unit 200, receives power supplied from the outdoor unit 200, and drives the indoor fan, i.e., a load, using the received power.

When an operation command is input from a user through an input unit or a controller, the indoor unit 100 performs an operation mode corresponding to the input operation command while controlling driving of various loads.

The controller (not shown) is connected to the indoor unit 100 wirelessly or by wire, receives the operation command input from the user, and transmits the received operation command to the indoor unit 100.

The indoor unit 100 converts the state thereof to a standby mode when the operation command is not input within a designated time after stoppage of operation.

When the indoor unit 100 enters the standby mode, the indoor unit 100 turns all the loads off and converts the state of only a first control unit to a sleep mode in order to minimize standby power.

The first control unit of the indoor unit 100 sets some ports as interrupt ports I to perform wake up by a signal input from the outside, and generates a trigger signal when a signal is input through the set interrupt port I, thus releasing the standby mode and returning to the operation mode.

The indoor unit 100 transmits a standby mode release signal to the outdoor unit 200 through the communication lines CL1 and CL2.

Further, the indoor unit 100 receives the standby mode release signal from the outdoor unit 200 through the communication lines CL1 and CL2 during the standby mode, and converts the state thereof to the operation mode when the indoor unit 100 receives the standby mode release signal.

The outdoor unit 200 is connected to the indoor unit 100 through the refrigerant pipe (not shown), and thus a refrigerant is circulated between the indoor unit 100 and the outdoor unit 200.

The outdoor unit 200 includes a compressor compressing the refrigerant into a high-temperature and high-pressure state, an outdoor heat exchanger discharging latent heat to the outside while converting the refrigerant in the high-temperature and high-pressure state compressed by the compressor into a liquid state, an expansion device, such as a capillary tube, reducing pressure of the refrigerant in the liquid state by adjusting flow of the refrigerant, and an outdoor fan blowing air to the outdoor heat exchanger.

The compressor, the outdoor heat exchanger and the expansion device are connected through refrigerant pipes, and the refrigerant pipe connected to the expansion device of the outdoor unit 200 is connected to the indoor heat exchanger of the indoor unit 100 through an external refrigerant pipe (not shown).

The outdoor unit 200 is electrically connected to the indoor unit 100 through the two power lines PL1 and PL2. The outdoor unit 200 is connected to an external commercial power supply, receives AC power supplied from the external commercial power supply, and supplies the received power to the indoor unit 100 through the two power lines PL1 and PL2.

The outdoor unit 200 is electrically connected to the indoor unit 100 through the two communication lines CL1 and CL2. The outdoor unit 200 selectively drives the outdoor fan and the compressor, i.e., loads, corresponding to the operation command transmitted from the indoor unit 100 to control the flow of the refrigerant circulated in the indoor unit 100, thereby performing the operation mode.

The outdoor unit 200 converts the state thereof to the standby mode when the operation command is not input through the two communication lines CL1 and CL2 within a designated time after stoppage of operation, and converts the state thereof to the operation mode when the operation command is input from the indoor unit 100.

Further, the outdoor unit 200 may convert the state thereof to the standby mode when a standby mode signal is received from the indoor unit 100, and may release the standby mode and then convert the state thereof to the operation mode when the standby mode release signal is received from the indoor unit 100.

When the outdoor unit 200 enters the standby mode, the outdoor unit 200 turns all the loads off and converts the state of only a second control unit to a sleep mode in order to minimize standby power.

The second control unit of the outdoor unit 200 sets some ports as interrupt ports I to perform wake up by a signal input from the outside, and generates a trigger signal when a signal is input through the set interrupt port I, thus releasing the standby mode and returning to the operation mode.

Further, the outdoor unit 200 transmits the standby mode release signal to the indoor unit 100 when operation, such as heating of a wire wound on the compressor, is carried out, although the outdoor unit 200 does not receive the operation mode input from the indoor unit 200 during the standby mode.

The outdoor unit 200 transmits the standby mode release signal to the indoor unit 100 through the communication lines CL1 and CL2.

Hereinafter, the configurations of the indoor unit 100 and the outdoor unit 200 performing the standby mode and releasing the standby mode will be described with reference to FIGS. 2 and 3.

Figure 2:
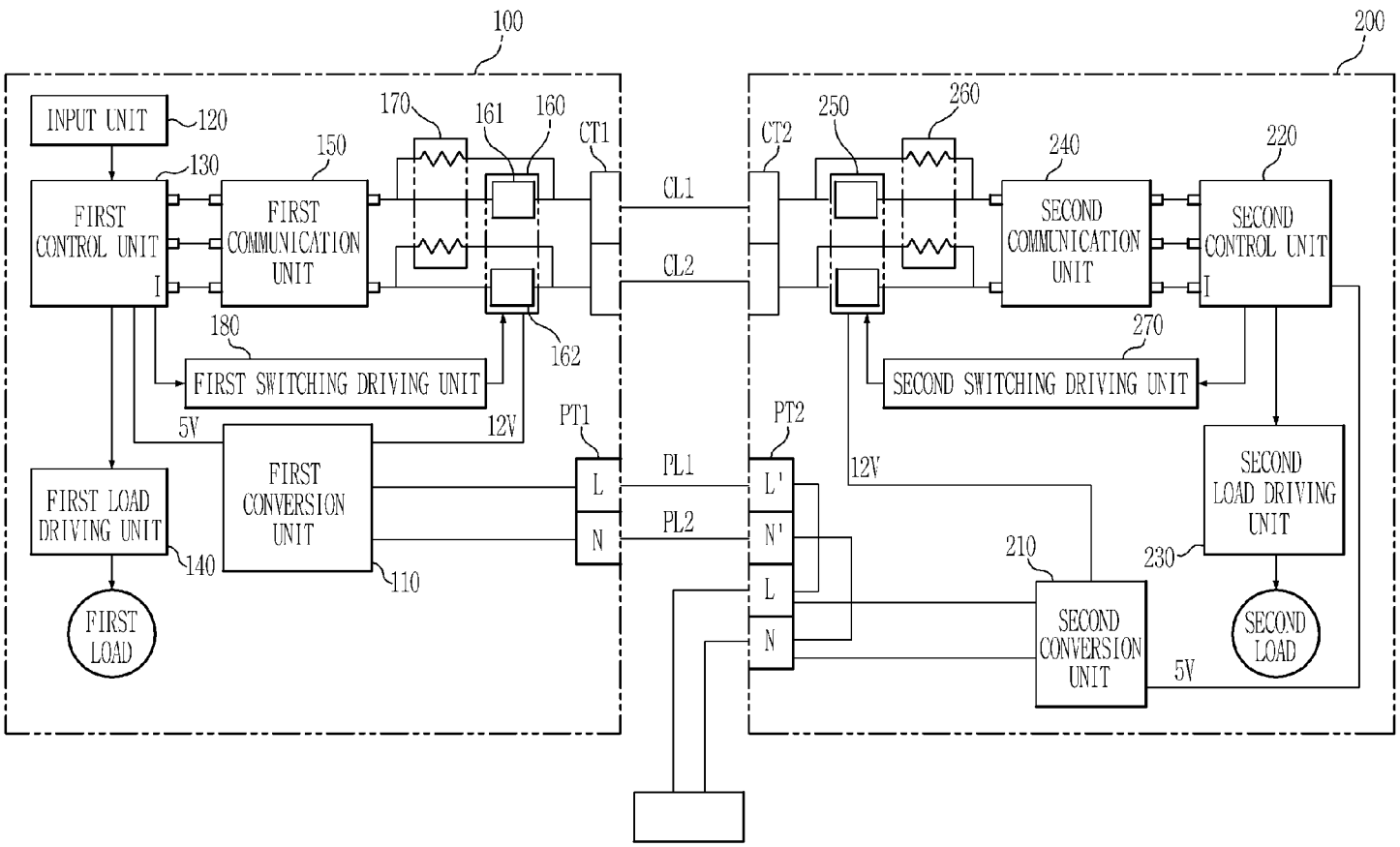
FIG. 2 is a view illustrating the detailed configuration of the air conditioner in accordance with an embodiment of the present disclosure.

FIG. 2 is a view illustrating the detailed configuration of the air conditioner in accordance with embodiment of the present disclosure.

The indoor unit 100 includes a first conversion unit 110, an input unit 120, a first control unit 130, a first load driving unit 140, a first communication unit 150, a first switching unit 160, a first voltage distribution unit 170 and a first switching driving unit 180, and the outdoor unit 200 includes a second conversion unit 210, a second control unit 220, a second load driving unit 230, a second communication unit 240, a second switching unit 250, a second voltage distribution unit 260 and a second switching driving unit 270.

The first conversion unit 110 of the indoor unit 100 is connected to a first power terminal assembly PT1 (N, L), receives external commercial AC power supplied from the first power terminal assembly PT1, converts the received external commercial AC power into DC power, and converts voltage of the converted DC power into driving voltages necessary to drive the respective components 120, 130, 140, 150 and 160 and the first loads.

For example, the first conversion unit 110 converts the voltage of the power into voltage necessary to drive the first control unit 130 and the first communication unit 150, for example, about 5V, and voltage necessary to drive the first switching unit 160, for example, about 12V.

The first power terminal assembly PT1 (N, L) is connected to the outdoor unit 200 through the two power lines PL1 and PL2, and receives external commercial power supplied from the outdoor unit 200.

The input unit 120 receives an operation command input through a plurality of buttons, and transmits the operation command to the first control unit 130. The plurality of buttons are pressed by a user, and include a power on/off button, a function setting button, a target temperature setting button, etc.

The first control unit 130 controls driving of the first loads based on the operation command transmitted from the input unit 120 or the controller (not shown) and an indoor temperature detected through an indoor temperature detection unit (not shown), thereby performing the operation mode.

Further, the first control unit 130 generates a control signal of second loads based on the operation command and the indoor temperature, and transmits the generated control signal to the outdoor unit 200 through the first communication unit 150.

The first loads include the indoor fan blowing heat-exchanged air, and the second loads include the outdoor fan blowing heat-exchanged air and the compressor compressing the refrigerant.

Further, the indoor unit 100 may transmit signals corresponding to the operation command and the indoor temperature to the outdoor unit 200 through the first communication unit 150.

The first control unit 130 counts time from stoppage of operation, determines a point in standby mode entering time if the counted time is more than a designated time, converts the state thereof into the standby mode from the point in standby mode entering time, and releases the standby mode and converts the state thereof into the operation mode if the operation command is input during the standby mode.

The first control unit 130 turns the first switching unit 160 off when the first control unit 130 enters the standby mode, generates a trigger signal when the standby mode release signal is transmitted to the first control unit 130 through the first communication unit 150, and releases the standby mode and turns the first switching unit 160 on when the trigger signal is generated.

The first control unit 130 controls turning-on/off of the first switching unit 160, thereby preventing driving voltage from being supplied to the first communication unit 150 during the standby mode and allowing driving voltage to be supplied to the first communication unit 150 during the operation mode. Thereby, standby power consumed in the standby mode may be minimized.

The first control unit 130 turns the first switching unit 160 on when voltage of DC power is supplied from the first conversion unit 110 to the first control unit 130, thereby electrically connecting the indoor unit 100 and the outdoor unit 200.

Further, the first switching unit 160 maintains the off state when voltage of DC power is not supplied from the first conversion unit 110 to the first control unit 130. Thereby, burning of the first communication unit 150 may be prevented.

The first control unit 130 may control driving of the first switching unit 160 based on voltage detected by a voltage detection unit (not shown) installed at a first communication terminal assembly CT1 or the first power terminal assembly PT1.

The first load driving unit 140 drives various first loads according to a command from the first control unit 130 in the operation mode, and interrupts power supplied to the first loads in the standby mode.

The first communication unit 150 receives voltage necessary for driving supplied from the first conversion unit 110 in the operation mode, and transmits a signal corresponding to a command from the first control unit 130 to the outdoor unit 200.

The first communication unit 150 interrupts voltage supplied from the first conversion unit 110 in the standby mode, thereby converting the state thereof into the off state.

The first communication unit 150 includes at least one input terminal and at least one output terminal inputting and outputting signals. The input terminal and the output terminal may be integrated into one integrated input and output terminal, or may be formed separately.

The first communication unit 150 in accordance with this embodiment includes two input and output terminals, each of which includes an input terminal and an output terminal integrated. Hereinafter, the two input and output terminals will be described with reference to FIG. 3.

Figure 3:
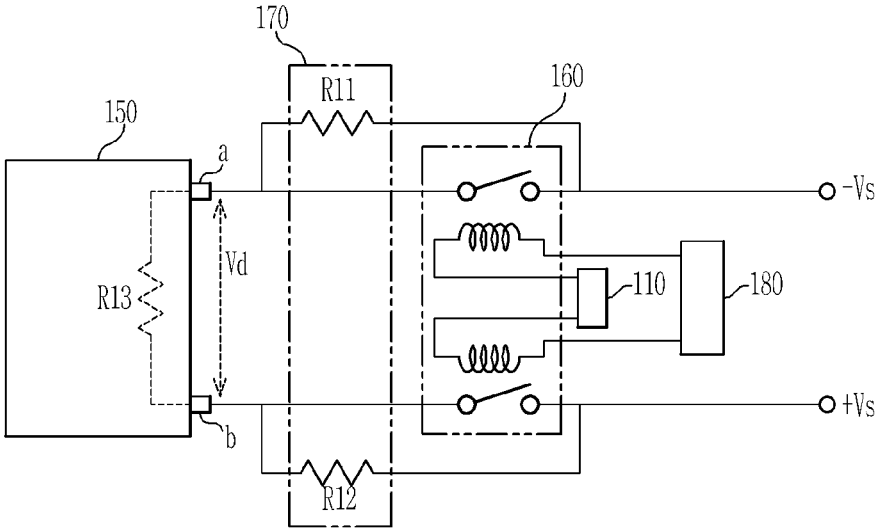
FIG. 3 is a view illustrating the detailed configuration of a first conversion unit and a first voltage distribution unit provided on the air conditioner in accordance with an embodiment of the present disclosure.

As shown in FIG. 3, the first communication unit 150 includes a first input and output terminal a and a second input and output terminal b which input and output signals.

The first input and output terminal a of the first communication unit 150 inputs and outputs a non-inverted signal from among communication signals, and the second input and output terminal b inputs and outputs an inverted signal from among the communication signals. The first communication unit 150 may restore the communication signals in consideration of differential voltage between the non-inverted signal and the inverted signal during transmission of signals.

The first communication unit 150 generates the standby mode release signal and transmits the generated standby mode release signal to the first control unit 130 when voltage more than a designated voltage is applied to the first and second input and output terminals a and b under the condition that voltage supplied from the first conversion unit 110 is interrupted during the standby mode.

An impedance R13 is provided between the first input and output terminal a and the second input and output terminal b of the first communication unit 150, and the standby mode release signal is generated according to voltage Vd applied to the impedance R13.

The first communication unit 150 may generate the standby mode release signal when the voltage Vd applied to the impedance R13 is more than reference voltage Vr.

The reference voltage Vr is varied according to a communication element forming the first communication unit 150, and the impedance R13 is also varied according to the communication element forming the first communication unit 150.

The first switching unit 160 is turned on in the operation mode according to the command from the first control unit 130 and thus forms a closed circuit between the indoor unit 100 and the outdoor unit 200, and is turned off in the standby mode.

Such a first switching unit 160 may include relays.

The first switching unit 160 includes a first relay 161 connected to the first input and output terminal a of the first communication unit 150 and a second relay 162 connected to the second input and output terminal b, and the first and second relays 161 and 162 are turned on by power supplied from the first conversion unit 110 according to driving of the first switching driving unit 180.

The first voltage distribution unit 170 forms a closed circuit between the outdoor unit 200 and the first communication unit 150 in the standby mode. The first switching unit 160 is turned off in the standby mode under the condition that the first voltage distribution unit 170 is connected to the first switching unit 160 in parallel.

Thereby, voltage of a signal output from the outdoor unit 200 in the standby mode is applied to the first voltage distribution unit 170.

The first voltage distribution unit 170 includes resistances, and these resistances are connected to the relays 161 and 162 in parallel.

The first voltage distribution unit 170 includes a first resistance R11 connected to the first relay 161 in parallel and a second resistance R12 connected to the second relay 162 in parallel, and the first resistance R11 and the second resistance R12 distribute voltage Vs of a signal output from the outdoor unit 200 and transmits the distributed voltage to the first communication unit 150 when the signal output from the outdoor unit 200 is input to the first voltage distribution unit 170 in the standby mode.

Three resistances, i.e., the first resistance R11, the second resistance R12 and the impedance R13, distribute the voltage Vs of the signal output from the outdoor unit 200.

The standby mode release signal is generated by voltage applied between the first and second input and output terminals a and b of the first communication unit 150, i.e., voltage Vd applied to the impedance R13, and the first control unit 130 generates the trigger signal by the standby mode release signal and thus wakes up from the sleep mode.

When the voltage Vd applied to the impedance R13 is more than the reference voltage Vr, the standby mode release signal may be generated.

$$Vd=(R13*Vs)/(R11+R12+R13),\ Vd\geq Vr$$

Thereby, values of the first resistance R11 and the second resistance R12 are selected in consideration of the impedance R13 between the first and second input and output terminals a and b of the first communication unit 150 and the reference voltage Vr to generate the standby mode release signal.

The first switching driving unit 180 turns the first switching unit 160 on/off according to the command from the first control unit 130. That is, the first switching driving unit 180 turns the first switching unit 160 off in the standby mode, and turns the first switching unit 160 on in the operation mode.

Further, the first switching driving unit 180 turns the first switching unit 160 on when communication lines CL1 and CL2 are connected to the first communication unit 150.

When the power lines PL1 and PL2 are connected to the first power terminal assembly PT1 of the indoor unit 100 and the communication lines CL1 and CL2 are connected to the first communication unit 150, the first switching unit 160 is turned on, and when the communication lines CL1 and CL2 are connected to the first power terminal assembly PT1 and the power lines PL1 and PL2 are connected to the first communication unit 150, driving voltage is not applied to the first control unit 130 and thus the first switching unit 160 maintains the off state. Thereby, although the power lines PL1 and PL2 are connected to the first communication unit 150 by mistake, a failure of the first communication unit 150 may be prevented.

The indoor unit 100 further includes the first communication terminal assembly CT1 to which the two communication lines CL1 and CL2 are connected.

The first switching unit 160 and the first voltage distribution unit 170 are connected to the first communication terminal assembly CT1, and the first communication terminal assembly CT1 is connected to the first communication unit 150 through the first switching unit 160 and the first voltage distribution unit 170.

That is, the first communication terminal assembly CT1 electrically connects the first switching unit 160 and the first voltage distribution unit 170 to the two communication lines CL1 and CL2.

Further, the indoor unit 100 may further include a voltage detection unit (not shown) installed at the first communication terminal assembly CT1, and may determine whether or not lines connected to the first communication unit 150 are the communication lines or the power lines based on voltage detected through the voltage detection unit. In this case, when the power lines are connected to the first communication unit 150, voltage of AC is detected, and when the communication lines are connected to the first communication unit 150, voltage of DC is detected.

Further, the indoor unit 100 may further include a voltage detection unit (not shown) installed at the first power terminal assembly PT1, and may determine whether or not lines connected to the first power terminal assembly PT1 are the communication lines or the power lines based on voltage detected through the voltage detection unit, thereby being capable of predicting whether or not lines connected to the first communication unit 150 are the communication lines or the power lines.

The second conversion unit 210 of the outdoor unit 200 is connected to a second power terminal assembly PT2, receives external commercial AC power, converts the received external commercial AC power into DC power, and converts voltage of the converted DC power into driving voltages necessary to drive the respective components.

For example, the second conversion unit 210 converts the voltage of the power into voltage necessary to drive the second control unit 220 and the second communication unit 240, for example, about 5V, and voltage necessary to drive the second switching unit 250, for example, about 12V.

The second power terminal assembly PT2 includes four terminals (L: Live, N: Neutral, L', N'), two terminals (L, N) from among the four terminals (L, N, L', N') are connected to an external commercial power supply, and the remaining two terminals (L', N') are respectively connected to the terminals (L, N) connected to the external commercial power supply and are respectively connected to the first power terminal assembly PT1 of the indoor unit 100 through the two power lines PL1 and PL2, simultaneously.

The second control unit 220 counts time from stoppage of operation, determines a point in standby mode entering time if the counted time is more than a designated time, or determines the point in standby mode entering time if a standby mode signal is input from the indoor unit 100, converts the state thereof into the standby mode, and releases the standby mode and converts the state thereof into the operation mode if an operation command or a standby mode release signal is input from the indoor unit 100 during the standby mode.

The second control unit 220 performs communication with the indoor unit 100 in the operation mode, and thus may transmit data, such as an outdoor temperature, etc., to the indoor unit 100 and receive data, such as an indoor temperature, a target temperature, etc., from the indoor unit 100.

The second control unit 220 turns the second switching unit 250 off when the second control unit 220 enters the standby mode, generates a trigger signal when the standby mode release signal is transmitted to the second control unit 220 through the second communication unit 240, and releases the standby mode and turns the second switching unit 250 on when the trigger signal is generated.

The second control unit 220 controls turning-on/off of the second switching unit 250, thereby preventing driving voltage from being supplied to the second communication unit 240 during the standby mode and allowing driving voltage to be supplied to the second communication unit 240 during the operation mode. Thereby, standby power consumed in the standby mode may be minimized.

The second control unit 220 turns the second switching unit 250 on when voltage of DC power is supplied from the second conversion unit 210 to the second control unit 220, thereby electrically connecting the indoor unit 100 and the outdoor unit 200 so as to be in a communicable state.

When voltage of DC power is not supplied from the second conversion unit 210 to the second control unit 220 due to a line connection error between the terminals of the second power terminal assembly PT2, or a line connection error between the second power terminal assembly PT2 and the second communication terminal assembly CT2, the second switching unit 250 maintains the off state. Thereby, burning of the second communication unit 240 may be prevented.

The second control unit 220, although the operation command is not input from the indoor unit 100 during the standby mode, determines a point in a standby mode release time by determining a point in an operation time to improve functions (for example, heating of wire wound on the compressor), turns the second switching unit 250 on at the point in the standby mode release time, and transmits a standby mode release signal to the indoor unit 100 through the second communication unit 240.

The second load driving unit 230 drives various second loads according to a command from the second control unit 220 in the operation mode, and interrupts power supplied to the second loads in the standby mode.

The second loads include the compressor, the outdoor fan, the expansion device, and the outdoor temperature detection unit.

The second communication unit 240 receives voltage necessary for driving supplied from the second conversion unit 210 in the operation mode, and transmits a signal corresponding to a command from the second control unit 220 to the indoor unit 100.

The second communication unit 240 interrupts voltage supplied from the second conversion unit 210 in the standby mode, thereby converting the state thereof into the off state.

The second communication unit 240 includes at least one input terminal and at least one output terminal inputting and outputting signals. The input terminal and the output terminal may be integrated into one integrated input and output terminal, or may be formed separately.

The second communication unit 240 in accordance with this embodiment includes two input and output terminals, each of which includes an input terminal and an output terminal integrated. The two input and output terminals of the second communication unit 240 are the same as those of the first communication unit 150, and a detailed description thereof will thus be omitted.

The functions of the second communication unit 240, the second switching unit 250, the second voltage distribution unit 260, the second switching driving unit 270 of the outdoor unit 200 are the same as the functions of the first communication unit 150, the first switching unit 160, the first voltage distribution unit 170, the first switching driving unit 180 of the indoor unit 100, and a detailed description thereof will thus be omitted.

When one device of the indoor unit 100 and the outdoor unit 200 which receives power from the other device, there is a strong possibility that the power lines are connected to the communication unit thereof. In consideration of the above respect, a switching unit, a voltage distribution unit and the voltage adjustment unit may be installed only on the device receiving power from the other device.

Figure 4:
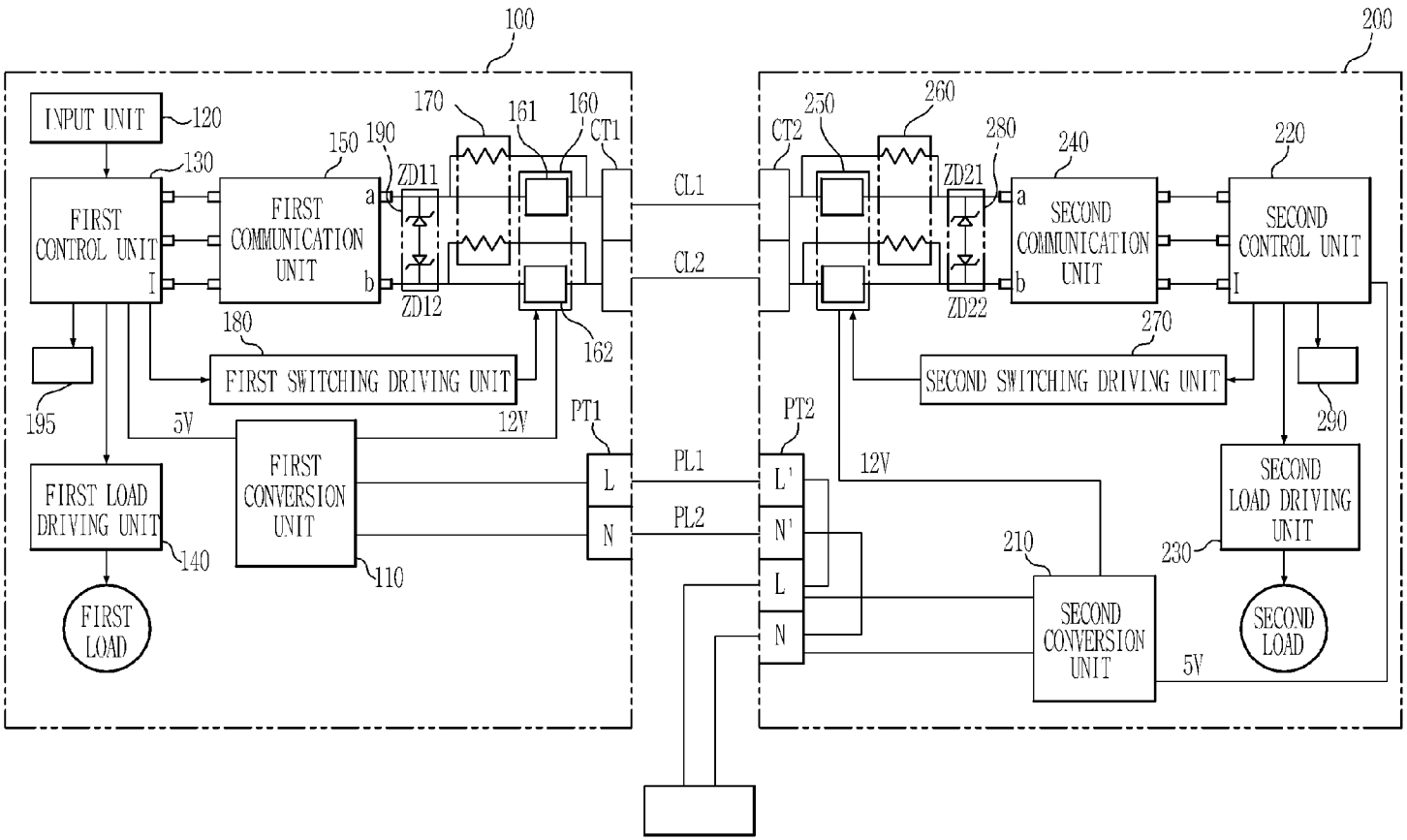
FIG. 4 is a view illustrating the detailed configuration of an air conditioner in accordance with another embodiment of the present disclosure.

FIG. 4 is a view illustrating the detailed configuration of an air conditioner in accordance with another embodiment of the present disclosure.

An indoor unit 100 includes a first conversion unit 110, an input unit 120, a first control unit 130, a first load driving unit 140, a first communication unit 150, a first switching unit 160, a first voltage distribution unit 170, a first switching driving unit 180 and a first voltage adjustment unit 190, and an outdoor unit 200 includes a second conversion unit 210, a second control unit 220, a second load driving unit 230, a second communication unit 240, a second switching unit 250, a second voltage distribution unit 260, a second switching driving unit 270 and a second voltage adjustment unit 280.

In this embodiment, the first voltage adjustment unit 190 is further provided between the first communication unit 150 and a first communication terminal assembly CT1, and the second voltage adjustment unit 280 is further provided between the second communication unit 240 and a second communication terminal assembly CT2. The first voltage adjustment unit 190 and the second voltage adjustment unit 280 prevent burning of the first and second communication units 150 and 240 due to line connection errors.

The configurations of the first conversion unit 110, the input unit 120, the first control unit 130, the first load driving unit 140 and the first communication unit 150 of the indoor unit 100 in this embodiment are the same as those in the former embodiment, and a detailed description thereof will thus be omitted.

As shown in FIG. 4, the first voltage adjustment unit 190 is located between a first input and output terminal a and a second input and output terminal b of the first communication unit 150.

The first voltage adjustment unit 190 includes a plurality of Zener diodes ZD11 and ZD12.

A cathode terminal of the first Zener diode ZD11 is connected to the first input and output terminal a of the first communication unit 150, a cathode terminal of the second Zener diode ZD12 is connected to the second input and output terminal b of the first communication unit 150, and thereby, anode terminals of the first and second Zener diodes ZD11 and ZD 12 contact each other.

When voltage exceeding a designated voltage is applied to the first voltage adjustment unit 190 through the power lines PL1 and PL2 connected to the first communication unit 150, the first voltage adjustment unit 190 adjusts the applied voltage to a designated voltage or less.

When voltage exceeding the designated voltage is applied to the cathode terminal of the first Zener diode ZD11, the first Zener diode ZD11 adjusts the applied voltage to a designated voltage or less.

The voltage applied to the cathode terminal of the first Zener diode ZD11 is voltage at the first resistance R11, and the voltage adjusted by the first Zener diode ZD11 passes through the anode terminal of the second Zener diode ZD12. The second Zener diode ZD12 performs the function of a general diode.

On the other hand, when voltage exceeding a designated voltage is applied to the cathode terminal of the second Zener diode ZD12, the second Zener diode ZD12 adjusts the applied voltage to a designated voltage or less.

The voltage applied to the cathode terminal of the second Zener diode ZD12 is voltage at the second resistance R12, and the voltage adjusted by the second Zener diode ZD12 passes through the anode terminal of the first Zener diode ZD11. The first Zener diode ZD11 performs the function of a general diode.

If communication lines CL1 and CL2 are connected to the first communication unit 150, voltage applied to the first Zener diode ZD11 through the communication line CL1 is reverse voltage below a designated voltage, and thus the first Zener diode ZD11 does not perform the voltage adjustment function.

Further, voltage applied to the second Zener diode ZD12 through the communication line CL2 is reverse voltage below a designated voltage, and thus the second Zener diode ZD12 does not perform the voltage adjustment function.

If the communication lines CL1 and CL2 are connected to the first communication unit 150, voltage applied through the communication lines CL1 and CL2 is applied to the first communication unit 150.

The first switching unit 160 is turned on in the operation mode according to the command from the first control unit 130 and thus forms a closed circuit between the indoor unit 100 and the outdoor unit 200, and is turned off in the standby mode. Such a first switching unit 160 includes relays.

The first switching unit 160 includes a first relay 161 connected to the first input and output terminal a of the first communication unit 150 and the cathode terminal of the first Zener diode ZD11, and a second relay 162 connected to the second input and output terminal b and the cathode terminal of the second Zener diode ZD12, and the first and second relays 161 and 162 are turned on by power supplied from the first conversion unit 110 according to driving of the first switching driving unit 180.

The first voltage distribution unit 170 forms a closed circuit between the outdoor unit 200 and the first communication unit 150 in the standby mode. The first switching unit 160 is turned off in the standby mode under the condition that the first voltage distribution unit 170 is connected to the first switching unit 160 in parallel.

Thereby, voltage of a signal output from the outdoor unit 200 in the standby mode is applied to the first voltage distribution unit 170.

The first voltage distribution unit 170 includes resistances, and these resistances are connected to the relays 161 and 162.

The first voltage distribution unit 170 includes a first resistance R11 connected to the first relay 161 in parallel and a second resistance R12 connected to the second relay 162 in parallel, the first resistance R11 is connected to the cathode terminal of the first Zener diode ZD11 of the first voltage adjustment unit 190, and the second resistance R12 is connected to the cathode terminal of the second Zener diode ZD12 of the first voltage adjustment unit 190.

The first resistance R11 and the second resistance R12 of the first voltage distribution unit 170 distribute voltage Vs of a signal output from the outdoor unit 200 and transmit the distributed voltage to the first communication unit 150 when the signal output from the outdoor unit 200 is input in the standby mode.

Three resistances, i.e., the first resistance R11, the second resistance R12 and the impedance R13, distribute the voltage Vs output from the outdoor unit 200.

The standby mode release signal is generated by voltage applied between the first and second input and output terminals a and b of the first communication unit 150, i.e., voltage Vd applied to the impedance R13, and the first control unit 130 generates the trigger signal by the standby mode release signal and thus wakes up from the sleep mode.

When the voltage Vd applied to the impedance R13 is more than the reference voltage Vr, the standby mode release signal may be generated.

Further, the first resistance R11 and the second resistance R12 of the first voltage distribution unit 170 distribute voltage applied through the power lines PL1 and PL when the power lines PL1 and PL2 are connected to the first communication unit 150.

The voltage distributed by the first resistance R11 and the second resistance R12 is adjusted to a designated voltage by the first and second Zener diodes ZD11 and ZD12.

The first resistance R11 and the second resistance R12 distribute the voltage of the power lines PL1 and PL2 applied through the first communication terminal assembly CT1 in the off state of the first switching unit 160, and the first and second Zener diodes ZD11 and ZD12 adjust the voltage distributed by the first resistance R11 and the second resistance R12 to a designated voltage or less.

Thereby, burning of the first communication unit 150 due to voltage applied through the power lines PL1 and PL2 when the power lines PL1 and PL2 are connected to the first communication unit 150 by mistake may be prevented.

The first switching driving unit 180 turns the first switching unit 160 on/off according to the command from the first control unit 130. The first switching driving unit 180 turns the first switching unit 160 off in the standby mode, and turns the first switching unit 160 on in the operation mode.

Further, the first switching driving unit 180 turns the first switching unit 160 on when the communication lines CL1 and CL2 are connected to the first communication unit 150.

When the power lines PL1 and PL2 are connected to the first power terminal assembly PT1 of the indoor unit 100 and the communication lines CL1 and CL2 are connected to the first communication unit 150, the first switching unit 160 is turned on, and when the communication lines CL1 and CL2 are connected to the first power terminal assembly PT1 and the power lines PL1 and PL2 are connected to the first communication unit 150, driving voltage is not applied to the first control unit 130 and thus the first switching unit 160 maintains the off state.

By distributing voltage of the power lines PL1 and PL2 applied through the power lines PL1 and PL2 through the first resistances R11 and R12 and then adjusting the distributed voltage through the first and second Zener diodes ZD1 and ZD2, although the power lines are connected to the first communication unit 150 by mistake, a failure of the first communication unit 150 may be prevented.

Further, although the relays 161 and 162 to prevent a failure due to a line connection error are turned off in the standby mode to save standby power, the standby mode may be released through the first and second resistances R11 and R12.

The configurations of the second conversion unit 210, the second control unit 220, the second load driving unit 230, the second communication unit 240, the second switching unit 250, the second voltage distribution unit 260 and the second switching driving unit 270 of the outdoor unit 200 in accordance with this embodiment are the same as those in accordance with the former embodiment, and a detailed description thereof will thus be omitted.

Further, the configuration of the second voltage adjustment unit 280 of the outdoor unit 200 in accordance with this embodiment is the same as that of the first voltage adjustment unit 190 of the indoor unit 100, and a detailed description thereof will thus be omitted.

Further, the indoor unit 100 and the outdoor unit 200 may further include output units 195 and 290 outputting connection states with the power lines PL1 and PL2 and the communication lines CL1 and CL2, respectively.

For example, when DC power, i.e., driving power, is applied to the first control unit 130, i.e., the first control unit 130 determines that the communication lines CL1 and CL2 are connected to the first communication unit 150, and informs of connection of the communication lines CL1 and CL2 to the first communication unit 150 by controlling driving of the first output unit 195.

These first and second output units 195 and 290 may be indicator lamps or alarm devices.

Figure 5A:
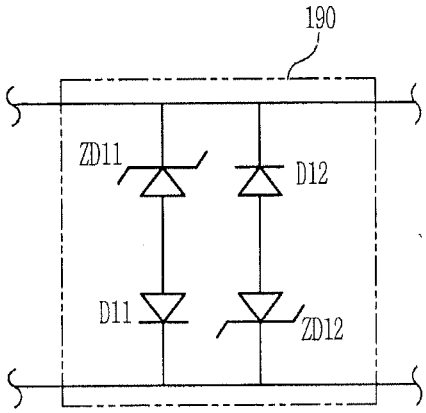
FIGS. 5(*a*) and 5(*b*) are views illustrating the configurations of voltage adjustment units provided on an air conditioner in accordance with another embodiment of the present disclosure.
Figure 5B:
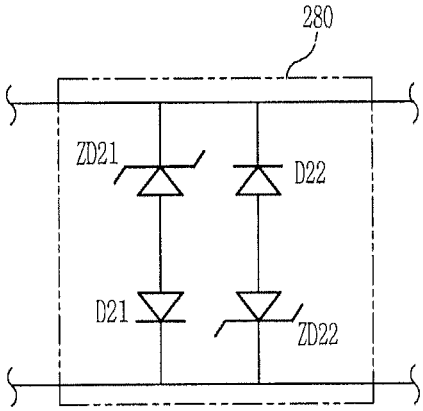

FIGS. 5(*a*) and 5(*b*) are views illustrating the detailed configurations of voltage adjustment units provided on an air conditioner in accordance with another embodiment of the present disclosure.

The first and second voltage adjustment units in accordance with the former embodiment may be configured, as shown in FIG. 5. In accordance with this embodiment, the configuration of the second voltage adjustment unit 280 is the same as the configuration of the first voltage adjustment unit 190, and thus only the first voltage adjustment unit 190 will be exemplarily described.

The first voltage adjustment unit 190 is located between the first input and output terminal a and the second input and output terminal of the first communication unit 150.

The first voltage adjustment unit 190 includes a plurality of Zener diodes ZD11 and ZD12 and a plurality of general diodes D11 and D12.

A cathode terminal of the first Zener diode ZD11 is connected to the first input and output terminal a of the first communication unit 150, a cathode terminal of the first general diode D11 is connected to the second input and output terminal b of the first communication unit 150, and thereby, anode terminals of the first Zener diode ZD11 and the first general diode D11 contact each other. These first Zener diode ZD11 and first general diode D11 form a first diode pair.

Further, a cathode terminal of the second general diode D12 is connected to the first input and output terminal a of the first communication unit 150, a cathode terminal of the second Zener diode ZD12 is connected to the second input and output terminal b of the first communication unit 150, and thereby, anode terminals of the second Zener diode ZD12 and the second general diode D12 contact each other. These second Zener diode ZD12 and second general diode D12 form a second diode pair.

The first diode pair and the second diode pair are provided in parallel.

When voltage exceeding a designated voltage is applied to the first voltage adjustment unit 190 through power lines PL1 and PL2 connected to the first communication unit 150, the first voltage adjustment unit 190 adjusts the applied voltage to a designated voltage or less.

When voltage exceeding the designated voltage is applied to the cathode terminal of the first Zener diode ZD11, the first Zener diode ZD11 adjusts the applied voltage to a designated voltage or less.

The voltage applied to the cathode terminal of the first Zener diode ZD11 is voltage at the first resistance R11, and the voltage adjusted by the first Zener diode ZD11 passes through the anode terminal of the first general diode D11.

Further, since voltage applied to the second general diode D12 through the second resistance R12 is reverse voltage, current does not flow in the second general diode D12.

On the other hand, when voltage exceeding the designated voltage is applied to the cathode terminal of the second Zener diode ZD12, the second Zener diode ZD12 adjusts the applied voltage to a designated voltage or less.

The voltage applied to the cathode terminal of the second Zener diode ZD12 is voltage at the second resistance R12, and the voltage adjusted by the second Zener diode ZD12 passes through the anode terminal of the second general diode D12.

Further, since voltage applied to the first general diode D11 through the first resistance R11 is reverse voltage, current does not flow in the first general diode D11.

The first Zener diode ZD11 adjusts voltage applied through the first resistance, and the second Zener diode ZD12 adjusts voltage applied through the second resistance.

If the power lines PL1 and PL2 are connected to the first communication unit 150, voltage of the power lines PL1 and PL2 are applied to the first communication unit 150 through the first communication terminal assembly CT1 in the off state of the first switching unit 160, the first resistance R11 and the second resistance R12 of the first voltage distribution unit 170 distribute the applied voltage, and the first and second Zener diodes ZD11 and ZD12 adjust the voltage distributed by the first resistance R11 and the second resistance R12 to a designated voltage.

As described above, by distributing voltage of the power lines PL1 and PL2 applied through the power lines PL1 and PL2 through the first resistances R11 and R12 and then adjusting the distributed voltage through the first and second Zener diodes ZD11 and ZD12, a failure of the first communication unit 150 may be prevented although the power lines are connected to the first communication unit 150 by mistake.

Further, although the relays 161 and 162 to prevent a failure due to a line connection error are turned off in the standby mode to save standby power, the standby mode may be released through the first and second resistances R11 and R12.

If communication lines CL1 and CL2 are connected to the first communication unit 150, voltage applied to the first Zener diode ZD11 through the communication line CL1 is reverse voltage below a designated voltage, and thus the first Zener diode ZD11 does not perform the voltage adjustment function.

Further, voltage applied to the second Zener diode ZD12 through the communication line CL2 is reverse voltage below a designated voltage, and thus the second Zener diode ZD12 does not perform the voltage adjustment function.

If the communication lines CL1 and CL2 are connected to the first communication unit 150, voltage applied through the communication lines CL1 and CL2 are applied to the first communication unit 150.

Figure 6:
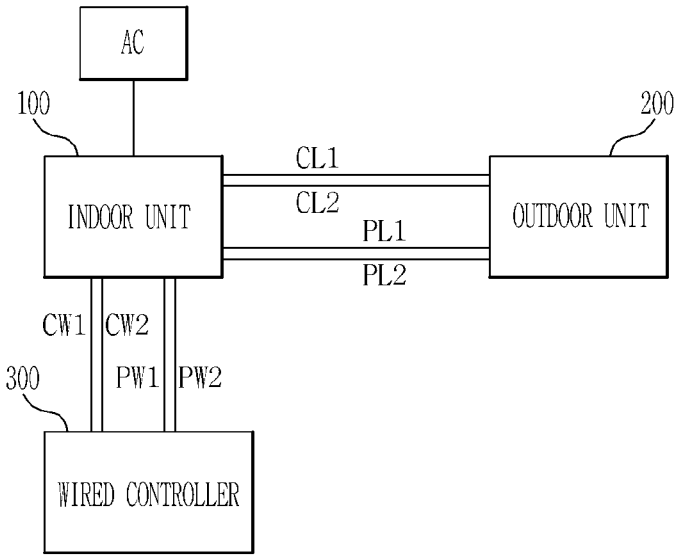
FIG. 6 is a view illustrating the configuration of an air conditioner in accordance with another embodiment of the present disclosure.
Figure 7:
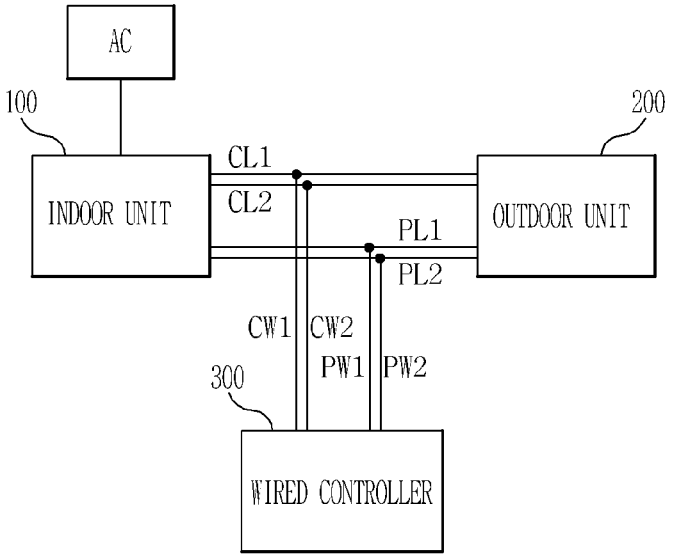
FIG. 7 is a view illustrating the configuration of an air conditioner in accordance with a further embodiment of the present disclosure.

FIG. 6 is a view illustrating the configuration of an air conditioner in accordance with another embodiment of the present disclosure, and FIG. 7 is a view illustrating the configuration of an air conditioner in accordance with a further embodiment of the present disclosure.

FIGS. 6 and 7 are views exemplarily illustrating air conditioners having different connection states between components from the air conditioner shown in FIG. 1.

The air conditioner shown in FIG. 6 includes an indoor unit 100 and an outdoor unit 200, and further includes a wired controller 300 connected to the indoor unit 100 by wire and controlling operation of the indoor unit 100.

The indoor unit 100 and outdoor unit 200 are electrically connected through two communication lines CL1 and CL2, and the indoor unit 100 and wired controller 300 are electrically connected through two communication lines CW1 and CW2, thus performing mutual communication.

Further, the indoor unit 100 and outdoor unit 200 are electrically connected through two power lines PL1 and PL2, and the indoor unit 100 and wire controller 300 are electrically connected through two power lines PW1 and PW2.

Thereby, the indoor unit 100 supplies power to the outdoor unit 200 and the wired controller 300 through the respective power lines PL1, PL2, PW1 and PW2.

In case of one device of the indoor unit 100, the outdoor unit 200 and the wired controller which receives power from another device, there is a strong possibility that the power lines are connected to the communication unit thereof. In consideration of the above respect, a switching unit, a voltage distribution unit and a voltage adjustment unit may be installed only on the device receiving power from another other device.

The indoor unit 100, the outdoor unit 200 and the wire controller 300 in accordance with the air conditioner in accordance with this embodiment may respectively include switching units, voltage distribution units and voltage adjustment units, and thereby a failure due to a line connection error between devices may be prevented and the standby mode may be released.

The air conditioner shown in FIG. 7 has a different connection state of the wired controller 300 from the air conditioner shown in FIG. 6.

The configurations of other components of the air conditioner shown in FIG. 7 are the same as those of the air conditioner shown in FIG. 6.

An indoor unit 100 and an outdoor unit 200 are electrically connected through two communication lines CL1 and CL2 and two power lines PL1 and PL2, thus performing mutual communication, and power is supplied from the indoor unit 100 to the outdoor unit 200 through the two power lines PL1 and PL2.

Communication lines CW1 and CW2 of the wired controller 300 are connected to the communication lines CL1 and CL2 between the indoor unit 100 and the outdoor unit 200, and thus the wired controller 300 performs communication with the indoor unit 100 through the respective communication lines CL1, CL2, CW1 and CW2. Power lines PW1 and PW2 of the wired controller 300 is connected to the power lines PL1 and PL2 between the indoor unit 100 and the outdoor unit 200, and thus the wired controller 200 receives power from the indoor unit 100 through the respective power lines PL1, PL2, PW1 and PW2. The wired controller 300 may receive power from the outdoor unit 200.

The indoor unit 100, the outdoor unit 200 and the wire controller 300 in accordance with the air conditioner in accordance with this embodiment may respectively include switching units, voltage distribution units and voltage adjustment units, and thereby a failure due to a line connection error between devices may be prevented and the standby mode may be released.

As is apparent from the above description, an air conditioner according to an embedment of the present disclosure may save standby power in a standby mode and release the standby mode when a standby mode release signal from another device is received.

Further, the air conditioner may distribute voltage supplied to a communication unit and adjusts the distributed voltage when a line connection error between devices occurs, thereby preventing a failure due to the line connection error between the devices.

The air conditioner may receive the standby mode release signal in the standby mode while protecting the communication unit when a power line connection error occurs.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An indoor unit or an outdoor unit of an air conditioner comprising:

a communication terminal to receive a signal including a voltage through communication lines in response to said indoor unit or said outdoor unit being in a standby mode;

a switching unit, connected to the communication terminal, to be turned off in response to said indoor unit or said outdoor unit entering the standby mode, and to be turned on when the standby mode is released;

a voltage distribution unit, connected to the communication terminal in parallel with the switching unit, to receive the signal from the communication terminal and to distribute the voltage of the signal received by the voltage distribution unit;

a communication unit to receive the distributed voltage and, when the received distributed voltage is more than a reference voltage, to generate a standby mode release signal;

a voltage adjustment unit to adjust the distributed voltage received by the communication unit to an adjusted voltage when the distributed voltage received by the communication unit exceeds a designated voltage; and a control unit to turn the switching unit off in response to said indoor unit or said outdoor unit entering the standby mode, and to turn the switching unit on in response to the standby mode release signal being generated by the communication unit, wherein the switching unit forms a closed circuit between the communication terminal and the communication unit when on and forms an open circuit between the communication terminal and the communication unit when off, the switching unit is turned off when power lines are connected to the communication terminal, the voltage distribution unit distributes power line voltage applied through the power lines when the power lines are connected to the communication terminal, and the voltage adjustment unit adjusts the distributed power line voltage to the designated voltage or less, when the power lines are connected to the communication terminal.

2. The indoor unit or outdoor unit of the air conditioner according to claim 1, further comprising a conversion unit to respectively convert a voltage of a power supplied from outside into voltages to drive the communication unit, the switching unit and the control unit.

3. The indoor unit or outdoor unit of the air conditioner according to claim 2, wherein the control unit determines whether or not the communication lines are connected to the communication unit based on a voltage of a driving power applied from the conversion unit.

4. The indoor unit or outdoor unit of the air conditioner according to claim 3, wherein the control unit includes an output unit to inform a connection of the communication lines to the communication unit.

5. The indoor unit or outdoor unit of the air conditioner according to claim 1, wherein:

the switching unit includes relays; and the voltage distribution unit includes resistances.

6. The indoor unit or outdoor unit of the air conditioner according to claim 5, wherein the resistances are connected to the relays in parallel.

7. The indoor unit or outdoor unit of the air conditioner according to claim 1, wherein:

the communication unit includes a first input and output terminal and a second input and output terminal; and the voltage distribution unit includes a first resistance connected to the first input and output terminal and a second resistance connected to the second input and output terminal, and the voltage distribution unit distributes the voltage using the first resistance and the second resistance.

8. The indoor unit or outdoor unit of the air conditioner according to claim 7, further comprising an impedance between the first input and output terminal and the second input and output terminal, wherein the voltage distribution unit distributes the voltage using the first resistance, the second resistance and the impedance thereby generating a first resistance distributed voltage, a second resistance distributed voltage, and an impedance distributed voltage.

9. The indoor unit or outdoor unit of the air conditioner according to claim 8, wherein the impedance distributed voltage is used to generate a trigger signal of the control unit.

10. The indoor unit or outdoor unit of the air conditioner according to claim 7, wherein:

the switching unit includes a first relay connected to the first input and output terminal and a second relay connected to the second input and output terminal; and the first resistance is connected to the first relay in parallel and the second resistance is connected to the second relay in parallel.

11. The indoor unit or outdoor unit of the air conditioner according to claim 7, wherein the voltage adjustment unit is provided between the first input and output terminal and the second input and output terminal.

12. The indoor unit or outdoor unit of the air conditioner according to claim 11, wherein the voltage adjustment unit includes two Zener diodes, anodes of which contact each other.

13. The indoor unit or outdoor unit of the air conditioner according to claim 11, wherein the voltage adjustment unit includes two pairs of Zener diodes and general diodes parallel to each other, anodes of the Zener diode and the general diode in each pair contact each other.

14. The indoor unit or outdoor unit of the air conditioner according to claim 13, wherein one pair of Zener diode and general diode adjusts voltage applied to the first input and output terminal and the other pair of Zener diode and general diode adjusts voltage applied to the second input and output terminal.

* * * * *